US005353961A

United States Patent [19]

Debush

[11] Patent Number: 5,353,961

[45] Date of Patent: Oct. 11, 1994

[54] DUAL CHAMBER DISPENSER

[75] Inventor: George Debush, Hamden, Conn.

[73] Assignee: ReSeal International Limited Partnership, New York, N.Y.

[21] Appl. No.: 156,952

[22] Filed: Nov. 19, 1993

Related U.S. Application Data

[63] Continuation of Ser. No. 4,830, Jan. 15, 1993, abandoned.

[51] Int. Cl.[5] ..... B65D 35/22; B65D 25/08

[52] U.S. Cl. ..... 222/94; 222/129; 222/386.5; 222/207; 222/1; 206/221

[58] Field of Search ..... 222/94, 129, 145, 386.5, 222/206–213; 604/82, 83, 87, 88, 89, 90–92, 416; 206/219–222; 215/DIG. 8

[56] References Cited

U.S. PATENT DOCUMENTS

| | | | |
|---|---|---|---|
| 2,971,793 | 2/1961 | Peterson et al. | 222/129 X |
| 3,012,695 | 12/1961 | Lerner | 222/129 |
| 3,321,097 | 5/1967 | Solowey | 206/221 |
| 3,672,544 | 6/1972 | Marand | 222/145 X |
| 3,674,028 | 7/1972 | Ogle | 206/221 |
| 3,699,961 | 10/1972 | Szpur | 604/89 |
| 3,704,725 | 12/1972 | Marand | 222/145 X |
| 3,850,346 | 11/1974 | Richardson et al. | 222/145 |
| 3,977,568 | 8/1976 | Smith | 222/80 |
| 4,630,727 | 12/1986 | Feriani et al. | 206/221 |
| 4,779,722 | 10/1988 | Hall | 206/221 |
| 4,791,149 | 12/1988 | Pocknell | 222/145 X |
| 4,950,237 | 8/1990 | Henault et al. | 222/145 X |
| 4,961,516 | 10/1990 | Nakamura | 222/145 X |
| 5,058,770 | 10/1991 | Herold et al. | 222/80 |
| 5,088,627 | 2/1992 | Musel | 222/145 |
| 5,114,004 | 5/1992 | Isono et al. | 222/145 X |
| 5,176,634 | 1/1993 | Smith et al. | 206/221 X |

*Primary Examiner*—Andres Kashnikow
*Assistant Examiner*—Kenneth DeRosa
*Attorney, Agent, or Firm*—Anderson Kill Olick & Oshinsky

[57] ABSTRACT

A dual chamber dispenser is formed of a first chamber and a second chamber connected together by a one-way valve with the first chamber holding a flowable first component to be mixed at a time of use with a second component in the second chamber. The one-way valve permits flow from the first chamber into the second chamber but prevents any backflow from the second chamber to the first chamber. A metered dose outlet chamber is connected to the second chamber by way of another one-way valve, so that the mixed components can be directed into the outlet chamber but prevented from backflow into the second chamber. A dispensing head is connected to the outlet chamber for collapsing the outlet chamber and dispensing selected amounts of the mixed components. With the components in the first and second chambers kept in a separated condition the dispenser has a long shelf life though the mixed components have only a relatively short period of use after the mixing has been effected.

30 Claims, 2 Drawing Sheets

DUAL CHAMBER DISPENSER

This is a continuation of U.S. patent application Ser. No. 08/004,830, filed Jan. 15, 1993, now abandoned.

BACKGROUND OF THE INVENTION

The present invention is directed to a dispenser containing dual chambers. One of the chambers contains a substance to be mixed with another substance such as a diluent, in the other chamber. The chambers are maintained so that there is no flow between them during a storage period. When the dispenser is to be used, substances are mixed by introducing the substances from one chamber into the other.

In the past dual chamber dispensers have been used for solutions or mixtures having a relatively short use life. The two components of such a solution must be kept separate during shelf storage to prevent the deterioration of the solution prior to its use.

When the solution being used is a pharmaceutical or drug solution, it is important that the solution, when prepared for use, is maintained free of contamination. If contamination in the form of moisture, dust, gases in the ambient atmosphere and the like, enter the solution it is possible that the solution will be rendered unfit for use.

SUMMARY OF THE INVENTION

Therefore, it is the primary object of the present invention to provide a dispenser for dispensing a mixture or solution having a short use lifetime where the components of the mixture or solution are capable of being stored separately for an extended period, much longer than the lifetime of the mixed components.

In accordance with the present invention, the dispenser is provided with two separate collapsible chambers one holding one component or substance and the other holding a second component or substance to be mixed with the one component or solution before use.

While the solution to be dispensed may be made up of a solid substance and a fluid diluent, it is possible that the components of the solution to be dispensed may be made up of two fluids, a fluid and a gas, or two solid substances with at least one of them in a flowable condition.

In a preferred embodiment, the dispenser includes a collapsible enclosing container or housing with two collapsible containers or chambers within the enclosing housing. One of the collapsible chambers holds a fluid or flowable component to be mixed with a component in the other chamber.

In its original condition, that is, its storage condition, the chamber containing the flowable component is completely filled, so that it is in its fully expanded condition. A one-way valve connects the filled chamber to the other chamber containing the component to be mixed, with the other chamber in a collapsed condition. The one-way valve permits flow of the flowable component into the other chamber and prevents any backflow.

The component to be mixed may be a liquid, a gas, a powder or a solid, such as a freeze-dried cake, while the flowable component is a fluid diluent. Such a fluid diluent can be a liquid, a gas or other flowable substance.

The enclosing housing includes a removable overcap enclosing a dispensing head including a metered dose chamber and an outlet with a one-way Reseal valve positioned between the chamber and the outlet.

The housing is constructed with an activating member on its exterior which can be displaced in the axial direction of the chamber holding the flowable component. As the activating member is moved in the collapsing direction of the chamber, it forces the flowable component through the one-way valve into the other chamber so that the two components mix and form the solution or mixed components to be dispensed.

When the activating member is moved downwardly towards the base of the enclosing housing, the flowable component chamber is completely collapsed and, at the same time, the other chamber is filled with the flowable component and the other component in a mixed condition ready to be dispensed. It is important that the one-way valve between the two chambers prevents any flow of the flowable component into the other chamber during shelf storage, so that the components are not mixed until the mixture is ready to be used.

Generally speaking, the enclosing housing with the two collapsible chambers can be stored for an extended period affording a long shelf life, such as six to twelve months, as long as the components in the two chambers do not become mixed inadvertently, such as by leakage of one into the other.

Once the mixed components or solution has been prepared, the mixture has a much shorter lifetime than the components in the separated state, for instance, its use lifetime may be in the range of three to eight weeks. Accordingly, the two components should be mixed together only immediately prior to being used for the first time.

When the mixture is prepared and ready to be used, initially it expands and completely fills the other chamber. The other chamber is connected via a one-way valve with a metered dose chamber in a dispensing head. The dispensing head is arranged to collapse the metered dose chamber forming a negative pressure so that flow of the mixed components passes from the other chamber through the one-way valve into the metered dose chamber. The capacity of the metered dose chamber is usually much less than the other chamber so that it can dispense a desired number of metered doses. The one-way valve at the inlet to the metered dose chamber opens when the metered dose chamber is collapsed, whereby a negative pressure acts on the valve. With the metered dose chamber filled, the dispensing head can be operated, collapsing the metered dose chamber and dispensing a metered dose as required.

The dispensing head can include an applicator for dispensing the mixed components in a desired form, such as a spray, droplets or a steady stream. A particularizer can be used to form a mist.

To assure adequate pressure for dispensing the mixed substances in the form of a mist, the metered dose chamber includes a pressure amplifier.

As the mixed components are dispensed, the other chamber, originally filled with the mixed components, is gradually collapsed. The previously collapsed chamber which held the flowable component remains in the collapsed condition.

At the dispensing outlet, between the metered dose chamber and the outlet there is a Reseal valve, such as disclosed in U.S. Pat. No. 4,846,810 which permits the outflow of the mixed substances and prevents any backflow of the substances or of any contaminants into the metered dose chamber, assuring that no contaminants find there way into the other chamber holding the mixed components still to be dispensed.

In a preferred embodiment, the chambers within the enclosing housing are formed of bellows, so that the complete collapse of all three chambers, including the metered dose chamber, can be effected whereby it is assured that the maximum amount of the mixed components is utilized.

Preferably, the materials forming the chambers and the rest of the dispenser are recyclable plastics materials.

The base of the enclosing housing is shaped to facilitate the complete collapse of the chamber which holds the flowable component to be mixed with the component in the other chamber.

While bellows-shaped chambers are particularly effective, other types of chambers, such as collapsible bags and the like, can be used.

The material forming the chambers and the valves interconnecting the chambers are selected on the basis of compatibility with the components to be mixed and dispensed.

The various features of novelty which characterize the invention are pointed out with particularity in the claims annexed to and forming a part of this disclosure. For a better understanding of the invention, and its operating advantages attained by its use, reference should be had to the drawing and descriptive matter in which there are illustrated and described preferred embodiments of the invention.

DETAILED DESCRIPTION OF THE INVENTION

Figure 1:
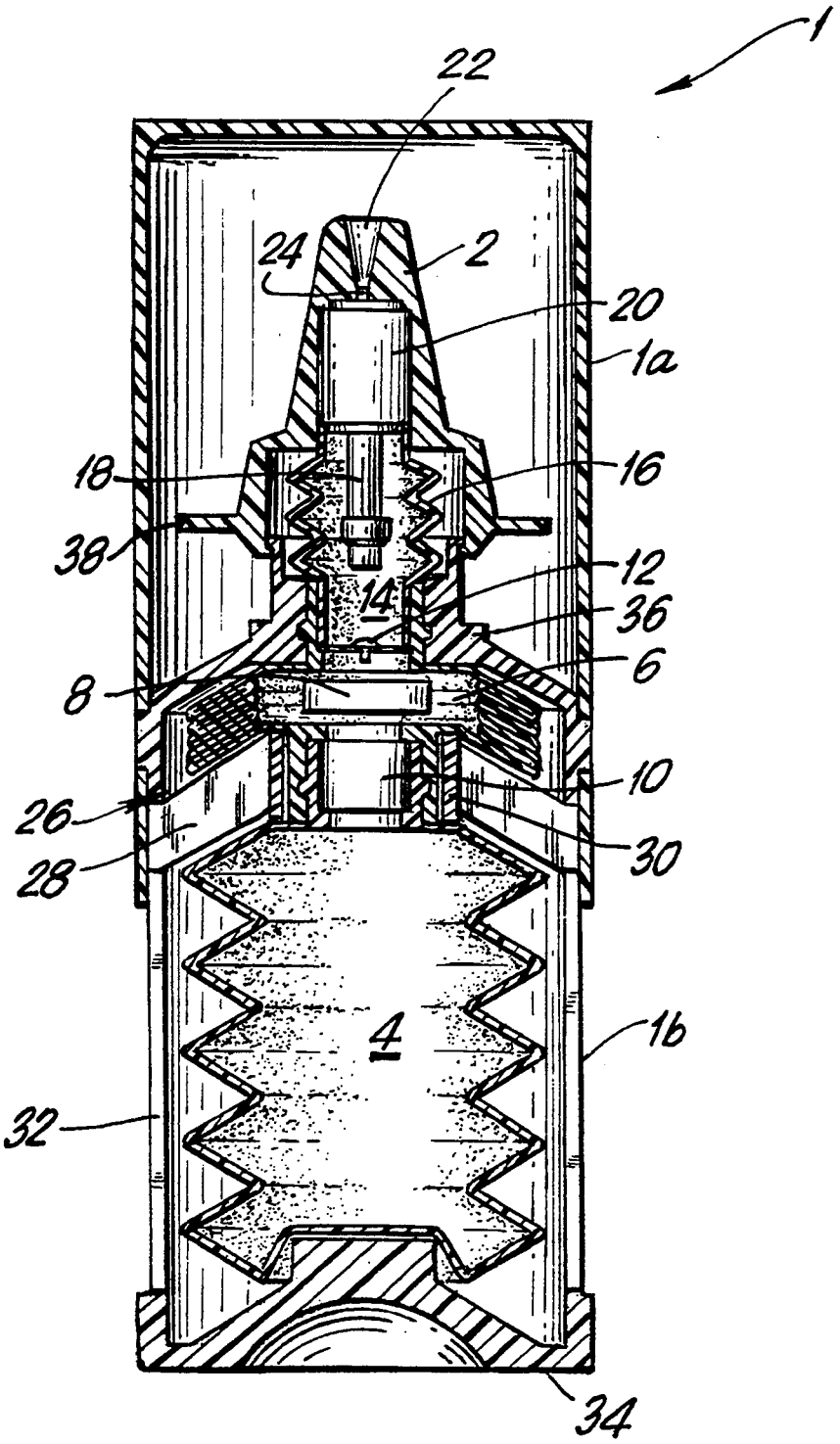
FIG. 1 is an elevational view, partly in section, of a dual chamber dispenser embodying the present invention and displayed in the storage condition.

In the drawings the dispenser includes an enclosing housing 1 including a removable overcap 1*a*. As can be seen in FIG. 1 the overcap la is mounted on a lower part 1*b* of the housing protecting a dispensing head 2.

Within the lower part 1*b* of the housing 1 there is a first collapsible bellows chamber 4 arranged to contain a diluent or other flowable component to be subsequently mixed. In FIG. 1 the first chamber 4 is in the fully expanded condition filled with the diluent while a similar second collapsible bellows chamber 6 contains a component, such as a freeze-dried cake 8 located in the second chamber 6 so that it can be mixed with the fluid diluent or flowable component in the first chamber 4 when needed. The first and second chambers 4, 6 are interconnected by a one-way valve 10 permitting flow from the first chamber 4 into the second chamber 6 but preventing any backflow into the first chamber.

The second chamber 6 is connected by a one-way valve 12 with a metered dose chamber 14. The metered dose chamber 14 is formed in part by a bellows section 16 enclosed within the dispensing head 2. A pressure amplifier 18 is located within the metered dose chamber 16 for providing the requisite pressure for dispensing the mixture in the desired form to Reseal valve 20 and the dispensing outlet 22 including, as required, an applicator 24, for dispensing the mixture in a desired form.

As can be seen in FIG. 1 the lower part lb of the enclosing housing 1 includes an activating member 26 connected by radially extending webs 28 to an inner member 30 laterally enclosing the one-way valve 10 located between the chambers 4 and 6. The activating member 26 and its attached parts is axially displaceable on the lower part 1*b* of the housing, note FIG. 2 and FIG. 3. The activating member 26 with the webs 28 and inner member 30 can move downwardly in slots 32 in the lower part 1*b* of the housing 1. The actuating member 26 can be ring-shaped.

Figure 3:
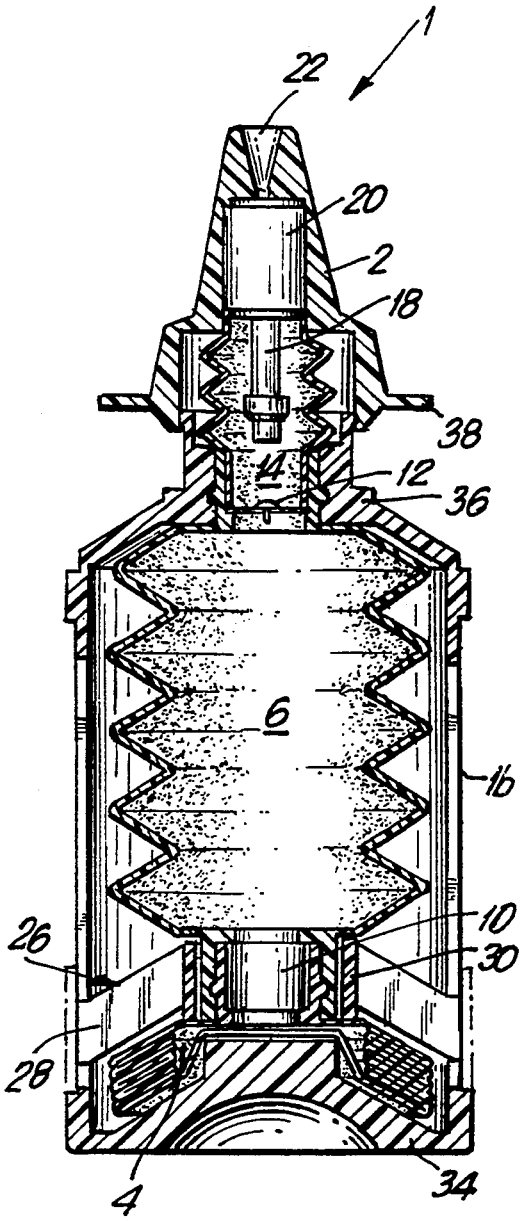
FIG. 3 is a view similar to FIGS. 1 and 2, however, illustrating the dispenser with the components to be dispensed in the fully mixed condition and ready to be dispensed.

The base 34 of the enclosing housing 1 is shaped to fit into the base of the first chamber 4 to facilitate the complete collapse of that chamber, as is shown in FIG. 3.

The dispensing head 2 is displaceably mounted on a neck part 36 at the upper end of the housing 1 so that by pressing down on the dispensing head it slides along the neck 36 and effects collapse of the metered dose chamber 14 for dispensing the mixed solution or components through the Reseal valve 20 and the dispensing outlet 22. Note the dispensing head 2 has an annular flange 38 so that a person using the dispenser can press downwardly on the flange and effect the collapse of the metered dose chamber.

In the storage condition of the dispenser as shown in FIG. 1, the component, such as a fluid diluent or a flowable solid material, such as a powder, or possibly a gas, fills the chamber 4 and is prevented from flowing into the second chamber 6 by the valve 10. In the storage condition the dispenser can be kept on the shelf for an extended period of time based on the characteristics of the components, such as six to twelve months, without the components deteriorating.

Figure 2:
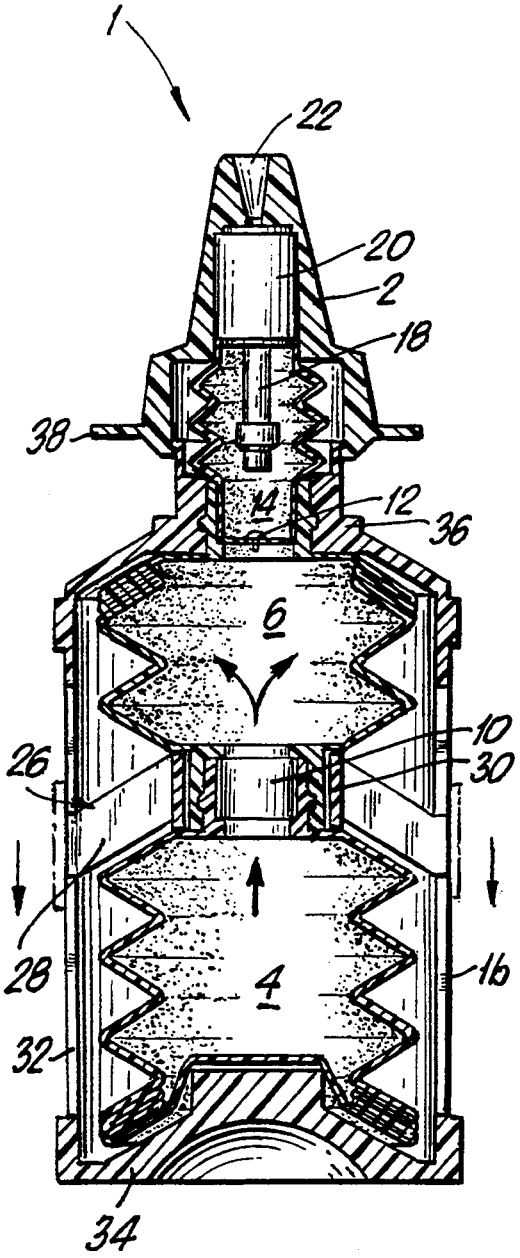
FIG. 2 is a view similar to FIG. 1 showing the dispenser during the mixing operation.

When the dispenser is to be placed in use, and preferably immediately before its first use, the activating member 26 is moved downwardly along with the webs 28 and the inner member 30 relative to the lower part lb of the housings, as shown in FIG. 2, causing the first chamber 4 to collapse and pressing the component in chamber 4 into the second chamber 6 where it mixes with the component 8 and forms a fluid solution or a flowable component mixture capable of being dispensed.

When the member 26 reaches the position shown in FIG. 3, the first chamber 4 is completely collapsed and all of its contents have been displaced through the valve 10 into the second chamber 6 now completely filled with the solution or mixed components to be dispensed. In the condition shown in FIG. 3 the dispenser is ready to be used and the cap la can be removed, so that the dispensing head 2 can be manually operated for discharging metered amounts of the mixed solution or components out of the dispenser.

By pressing downwardly on the flange 38, the dispensing head 2 is displaced downwardly and collapses the metered dose chamber 14 causing the bellows section 16 to collapse with the contents of the bellows section being dispensed through the Reseal valve 20. The Reseal valve is disclosed in U.S. Pat. No. 4,846,810, in particular note FIG. 2. The Reseal valve can be in the form of an elongated valve body as shown in the patent or in a disk-like form reducing the axial length of the dispensing head. The Reseal valve, as disclosed in the patent, permits flow out of the outlet 22 and assures, when the outlet flow is completed, that flow of contaminants back into the metered dose chamber is completely blocked. This feature is of great significance, since it assures that the mixed components to be dispensed are maintained in a completely hygienic or sanitary condition which is very important when drugs are being dispensed and could be of equal importance if the components to be dispensed would be rendered useless by air or other contaminants entering into the dispensing chamber.

The applicator 24 in the dispensing head 22 assures that the dispensed mixed components are in the proper form or condition.

Though not illustrated, as the mixed components flow out of the second chamber 6, the second chamber collapses and moves upwardly in the lower part lb of the housing. The second chamber 6 then assumes the condition as shown in FIG. 1 so that substantially all of the mixed components are discharged out of the dispenser. At the same time the first chamber 4 remains in the collapsed condition shown in FIG. 3.

While specific embodiments of the invention have been shown and described in detail to illustrate the inventive principles, it will be understood that the invention may be embodied otherwise without departing from such principles.

I claim:

1. A dispenser comprises a first collapsible member for holding a flowable first component to be mixed with a second component, a second collapsible member for holding the second component to be mixed with the first component for forming a mixture to be dispensed, a first one-way valve connecting the first collapsible member to the second collapsible member so that the first component can be forced into the second collapsible member but flow of the mixture from the second member into the first member is prevented, means for dispensing the mixture from the second member, and said dispensing means comprises a second one-way valve for delivering the mixture to a dispensing outlet and for preventing any backflow of the mixture or of contaminants from the ambient atmosphere through said outlet into said second member.

2. A dispenser, as set forth in claim 1, wherein said dispensing means includes an outlet chamber and a third one-way valve connecting the second member to said outlet chamber so that flow passes only from the second member to the outlet chamber and not from the outlet chamber to the second member.

3. A dispenser, as set forth in claim 2, wherein said second one-way valve is connected to said outlet for conducting the mixture from the outlet chamber to the outlet.

4. A dispenser, as set forth in claim 3, wherein said outlet chamber is compressible, and said dispensing means includes a device for compressing the outlet chamber for directing flow from said outlet chamber through said second one-way valve and out of said outlet.

5. A dispenser, as set forth in claim 4, wherein said dispensing means includes a fluid flow conditioning means located at said outlet for determining the condition of the mixture received from the second one-way valve and flowing out of said outlet.

6. A dispenser, as set forth in claim 2, including a housing enclosing said first and second members and said outlet chamber.

7. A dispenser, am set forth in claim 6, wherein said first and second members are collapsible.

8. A dispenser, as set forth in claim 7, wherein said first and second members have a collapsible bellows-like shape.

9. A dispenser, as set forth in claim 8, wherein said outlet chamber has at least a part thereof formed as a collapsible bellows-like section.

10. A dispenser, as set forth in claim 5, wherein said fluid flow conditioning means comprises an applicator located in said outlet for placing the mixed components in the desired condition.

11. A dispenser, as set forth in claim 6, wherein said housing has a base, an axially extending lower part extending upwardly from said base, an activating member displaceable in said lower part for collapsing said first chamber and a neck portion spaced axially at the opposite end of said lower part from said base for displaceably mounting a dispensing head.

12. A dispenser, as set forth in claim 11, wherein said housing includes a removable cap covering said dispensing head.

13. A dispenser, as set forth in claim 8, wherein said bellows-like section is completely collapsible so that its contents form a metered dose.

14. A dispenser, as set forth in claim 5, wherein said dispensing means includes a pressure amplifier located within said outlet chamber for providing the requisite pressure for dispensing the mixed components out of said outlet chamber.

15. Method of dispensing a solution formed by mixing a flowable first component with a second component comprising the steps of placing the first component in a collapsible first chamber, placing the second component in a collapsible second chamber and placing the second chamber in a collapsed condition, connecting the first and second chambers by a first one-way valve permitting flow only from the first chamber into the second chamber, connecting the second chamber via a one-way valve with a third chamber, connecting the third chamber via a one-way valve preventing flow back into the third chamber to a dispensing outlet, collapsing the first chamber for introducing the flowable first component therein into the second chamber for mixing with the second component in the second chamber, collapsing the third chamber for developing a negative pressure therein for drawing the mixed components from the second chamber into the third chamber, compressing the filled third chamber for displacing the contents thereof through the one-way valve connected to said dispensing outlet for dispensing the mixed components.

16. A dispenser comprises a housing, a first collapsible container for holding a flowable first component to be mixed with a second component and located in said housing, a second collapsible container for holding the second component to be mixed with the first component for forming a mixture to be dispensed and located in said housing, a first one-way valve connecting the first collapsible container to the second collapsible container so that the first component can be forced into the second collapsible member but flow of the mixture from the second member into the first member is prevented, a third collapsible container for receiving the mixture from the second container through a second one-way valve, an outlet connected to said third container by a third one-way valve for preventing any backflow of the mixture or contaminants from the ambient atmosphere through said outlet into said third container.

17. A dispenser, as set forth in claim 16, wherein said third container is compressible, and said third container is located within a displaceable dispensing head for compressing said third container.

18. A dispenser, as set forth in claim 17, wherein said outlet includes a fluid flow conditioning means located at said outlet for determining the condition of the mixture received from said third one-way valve and flowing out of said outlet.

19. A dispenser, as set forth in claim 18, wherein said first and second containers have a collapsible bellows-like shape.

20. A dispenser, as set forth in claim 19, wherein said third container has at least a part thereof formed as a collapsible bellows-like section.

21. A dispenser, as set forth in claim 18, wherein said fluid flow conditioning means comprises an applicator located in said outlet for placing the mixed components in the desired condition.

22. A dispenser, as set forth in claim 19, wherein said housing has a base, an axially extending lower part extending upwardly from said base, said first and second containers located in said lower part, an activating member displaceable in said lower part for collapsing said first container and a neck portion spaced axially at the opposite end of said lower part from said base for displaceably mounting said dispensing head.

23. A dispenser, as set forth in claim 22, wherein said housing includes a removable cap covering said dispensing head.

24. A dispenser, as set forth in claim 20, wherein said bellows-like section is completely collapsible so that its contents form a metered dose.

25. A dispenser, as set forth in claim 22, wherein a pressure amplifier is located within said third container for providing the requisite pressure for dispensing the mixed components out of said outlet chamber.

26. A dispenser comprises a housing, said housing comprises a base, a lower part extending upwardly from said base, a neck located at the upper end of said lower part, a dispensing head displaceably mounted on said neck, a first collapsible chamber for holding a flowable first component to be mixed with a second component and located in said lower part, a second collapsible chamber for holding the second component to be mixed with the first component for forming a mixture to be dispensed and located in said lower part, a first one-way valve connecting the first collapsible chamber to the second collapsible chamber so that the first component can be forced into the second collapsible chamber but flow of the mixture from the second chamber into the first chamber is prevented, a third collapsible chamber located in part in said neck and a remaining part in said dispensing head, a second one-way valve connecting said second chamber to said third chamber, dispensing means for dispensing the mixture from the third chamber, said dispensing means comprises a third one-way valve for delivering the mixture to a dispensing outlet in said dispensing head and for preventing any backflow of the mixture or of contaminants from the ambient atmosphere through said second member, said dispensing means includes a fluid flow conditioning means located at said outlet for determining the condition of the mixture received from the third one-way valve and flowing out of said outlet, said first and second chambers have a collapsible bellows-like shape, and said third chamber has at least a part formed as a collapsible bellow-like section.

27. A dispenser, as set forth in claim 26, wherein said fluid flow conditioning means comprises an applicator located in said outlet for placing the mixed components in the desired condition.

28. A dispenser, as set forth in claim 27, wherein said housing includes a removable cap covering said dispensing head.

29. A dispenser, as set forth in claim 26, wherein said bellows-like section is completely collapsible so that the contents form a metered dose.

30. A dispenser, as set forth in claim 26, wherein said dispensing means includes a pressure amplifier located within said third chamber for providing the requisite pressure for dispensing the mixed components out of said outlet chamber.

* * * * *